US012441533B2

(12) United States Patent
Brenneis

(10) Patent No.: US 12,441,533 B2
(45) Date of Patent: Oct. 14, 2025

(54) RECYCLABLE BALL CAN

(71) Applicant: Head Technology GmbH, Kennelbach (AT)

(72) Inventor: Simon Brenneis, Wasserburg (DE)

(73) Assignee: Head Technology GmbH, Kennelbach (AT)

( * ) Notice: Subject to any disclaimer, the term of this patent is extended or adjusted under 35 U.S.C. 154(b) by 0 days.

(21) Appl. No.: 17/938,179

(22) Filed: Oct. 5, 2022

(65) Prior Publication Data

US 2023/0115825 A1 Apr. 13, 2023

(30) Foreign Application Priority Data

Oct. 7, 2021 (DE) ..... 20 2021 003 146.4

(51) Int. Cl.
*B65D 85/58* (2006.01)
*A63B 47/00* (2006.01)

(52) U.S. Cl.
CPC ..... *B65D 85/58* (2013.01); *A63B 47/00* (2013.01); *B65D 2565/385* (2013.01)

(58) Field of Classification Search
CPC .... B65D 85/58; B65D 2565/385; A63B 47/00
USPC ..... 206/315.9, 459.1, 459.5
See application file for complete search history.

(56) References Cited

U.S. PATENT DOCUMENTS 431,132 A * 7/1890 Wharton ..... B01L 3/5082 422/549
2,355,108 A * 8/1944 Reese ..... B65D 17/464 229/5.5
3,233,727 A * 2/1966 Wilson ..... A63B 39/025 206/315.9
3,819,040 A * 6/1974 Coons ..... B65D 41/0442 206/315.9
3,853,222 A * 12/1974 Helms ..... A63B 39/025 53/88
3,888,347 A * 6/1975 Kramer ..... A63B 39/025 220/366.1
3,897,874 A * 8/1975 Coons ..... B65D 41/0442 206/315.9
4,124,117 A * 11/1978 Rudy ..... A63B 39/025 206/315.9
4,161,247 A * 7/1979 Feinberg ..... B65D 85/00 206/315.9
5,511,666 A * 4/1996 Grip ..... B65D 85/00 206/315.9
5,540,331 A * 7/1996 Wong ..... B65D 25/107 220/555
5,848,690 A * 12/1998 Granger ..... B65D 51/1677 206/315.9
5,875,891 A * 3/1999 Snell ..... B65D 85/58 206/315.9

(Continued)

OTHER PUBLICATIONS

Amazon website 3 count tennis per can. With weight of 207 gram. https://www.amazon.com/Penn-Championship-Extra-Tennis-Balls/dp/B0000BYRT0 (Year: 2003).*

(Continued)

*Primary Examiner* — Chun Hoi Cheung

(74) *Attorney, Agent, or Firm* — Bookoff McAndrews, PLLC

(57) ABSTRACT

The present invention relates to a ball can which can be particularly well recycled.

20 Claims, 1 Drawing Sheet

(56) References Cited

U.S. PATENT DOCUMENTS

| | | | | |
|---|---|---|---|---|
| 6,422,414 | B1 * | 7/2002 | Nakamura | B29C 49/06 220/675 |
| 6,901,668 | B2 * | 6/2005 | Elsener-Zehnder | B26B 29/025 206/460 |
| 7,048,975 | B1 * | 5/2006 | Tojo | B65D 1/0215 428/34.3 |
| 2004/0244242 | A1 * | 12/2004 | Maliner | G09F 3/0292 40/310 |
| 2007/0205178 | A1 * | 9/2007 | Kaufman | B65D 23/085 215/400 |
| 2014/0183078 | A1 * | 7/2014 | Newton | B29C 63/0013 156/60 |

OTHER PUBLICATIONS

Way back Machine on tennis ball weight for Wikipedia website. https://web.archive.org/web/20151104051836/https://en.wikipedia.org/wiki/Tennis_ball (Year: 2015).*

Yonex, "Micro X tennis balls (4 ball tube) by Tretorn", Aug. 4, 2014, <https://www.amazon.com/Micro-tennis-balls-ball-Tretorn/dp/B0016ZILNG/ref=sr_1_2?crid=36GT86NP9M9DM&keywords=tretorn+micro+x+tennis+balls&qid=1644518894&sprefix=tretorn+micro+x+tennis+balls%2Caps%2C53&sr=8-2>, 5 pages.

* cited by examiner

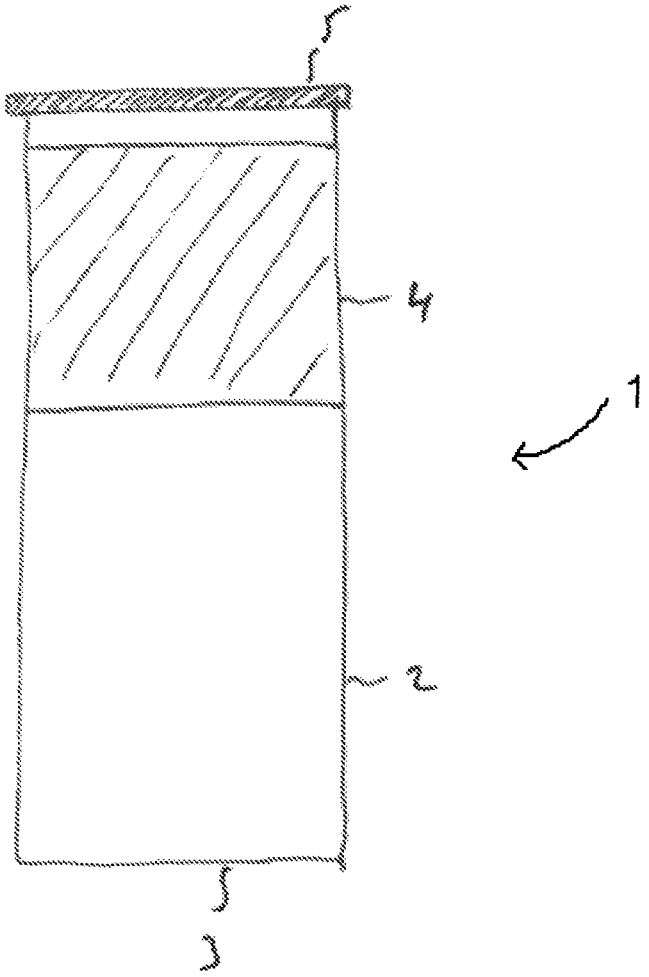
5
4
1
2
3

RECYCLABLE BALL CAN

This patent application claims the benefit under 35 U.S.C. 119 to German Utility Model Application No. DE 20 2021 003 146.4, filed on Oct. 7, 2021, the entirety of which is incorporated herein by reference.

The present invention relates to a ball can which can be particularly well recycled.

Ball cans for, for example, tennis balls or balls for padel tennis have been known for a long time. Typically, these balls are pressure packed, i.e., in order to avoid early pressure loss of the balls, which have a higher pressure inside than the atmospheric pressure, the balls are also stored in the packaging under higher pressure. The ball cans are typically made of a plastic material and have a breakaway aluminum closure. After the latter has been broken away to open the can for the first time, the can typically can be closed with a plastic cap or the like. Ball cans often are configured to be transparent, in order that the balls inside can be easily identified, and/or printed or provided with a band. However, this is disadvantageous in view of the recyclability of the individual can materials and/or components.

It is therefore an object of the present invention to provide a ball can which can be particularly well recycled or reprocessed. This object is achieved with a ball can according to claim 1. Preferred embodiments of the ball can according to the invention are described in the dependent claims.

Accordingly, the present invention is directed to a ball can comprising a can base and a, preferably cylindrical, can wall, wherein at least in one or more sections the can wall comprises a roughened surface and wherein, for marking the can, a layer of another material is applied to the can wall such that the surface roughened at least in one or more sections is at least partially exposed.

The ball can is preferably a ball can for tennis balls or balls for padel tennis. In principle, however, the ball can according to the invention is also suitable for other sports balls, in particular for other pressure-packed balls.

Although it is advantageous for the can wall to be circular cylindrical in view of the spherical shape of most balls, this is obviously not necessary. Rather, the can wall may also form a cylinder having a different base area, such as a triangular or square base area. The shape of the can wall can also deviate from a cylinder in the mathematical sense, for example in that the can wall is slightly corrugated, comprises indentations and/or bulges and/or deviates from the cylindrical shape in the region of the can base.

The ball can according to the invention is optimized for common recycling processes for several reasons. For example, it has turned out that the automatic recognition of different plastic materials during the recycling process can be carried out in a less error-prone manner if the corresponding material is roughened. Accordingly, the roughened surface of the can wall facilitates material recognition during the recycling process. For this purpose, it is further advantageous that the surface roughened at least in one or more sections is at least partially exposed, since a correct determination of the can material underneath the layer of the other material can be problematic.

Against this background, it is preferred that the can wall comprises an outer surface and that the layer of the other material covers at most 80%, more preferably at most 70%, even more preferably at most 60%, even more preferably at most 50% and particularly preferably at most 40% of this outer surface. Thus, a correspondingly large area is provided for correct material recognition.

The layer of another material for marking the can may be a sticker covering only a portion of the outer circumference of the can wall. However, it is preferred that the can wall comprises an outer circumference and that the layer of the other material extends around at least 50%, more preferably around at least 65%, even more preferably around at least 80% and particularly preferably around at least 90% of this outer circumference. However, in view of easy manufacturability of the ball can according to the invention and the simplest possible separation of the can from the layer of the other material, it is particularly preferred that the layer of the other material comprises a band or the like extending around the entire outer circumference of the ball can. The two ends of the band may be arranged to overlap one another in the longitudinal direction.

Preferably, the layer of the other material is adhered to the can wall, the adhesion preferably not being over the entire surface. Preferably, the adhesive area measures at most 3,000 $mm^2$, more preferably at most 2,500 $mm^2$, even more preferably at most 2,000 $mm^2$, even more preferably at most 1,000 $mm^2$ and particularly preferably at most 500 $mm^2$. In the case of a band, for example, only an adhesive strip can be provided, which extends over the entire width of the band. Particularly preferably, only punctiform adhesion is effected at one or a few points. Minimizing the adhesive area facilitates the removal operation during the recycling process.

Against this background, it is particularly preferred that the adhesive is water-soluble so that a corresponding material separation can be carried out in a particularly environmentally friendly manner. Preferably, the adhesive comprises one or a combination of the following materials: hot-melt adhesive (hot glue) based on ethylene vinyl acetate (EVA) or on polyethylene.

It is further preferred that the material of the layer of the other material has another density than the density of the ball can material, wherein the difference in density is preferably at least 0.02 $g/cm^3$, more preferably at least 0.05 $g/cm^3$ and particularly preferably at least 0.1 $g/cm^3$. Due to the different density, the layer of the other material can be relatively easily and automatically separated from the ball can material after detachment so that the latter is not contaminated during shredding.

The layer of the other material preferably comprises one or a combination of the following materials: oriented polypropylene (OPP), PET (polyethylene terephthalate), pearlescent BOPP films (BOPP=biaxially stretched polypropylene), coated paper, bio-polylactide (PLA), e.g. from corn starch.

The ball can, i.e. in particular the can base and the cylindrical can wall, preferably comprises one or a combination of the following materials: polyethylene, polypropylene, polyethylene terephthalate, polycarbonate, aluminum, tin paper, wood, bamboo, coated paper.

In view of better processing during the recycling process, it is further preferred that the weight of the ball can, i.e. in particular of the can base and the cylindrical can wall without the lid and the layer of another material, is at most 40 g, more preferably at most 38 g and particularly preferably at most 37 g.

The roughness of the ball can wall can be characterized by one or more of the following parameters: Ra at least 0.5 μm, Ra at least 1.0 μm, Ra at least 1.5 μm, Ra at least 2.0 μm, Rz at least 2.0 μm, Rz at least 4.0 μm, Rz at least 6.0 μm, Rz at least 8.0 μm, Rz at least 10.0 μm.

The parameters Ra and Rz can be determined, for example, with the Surface Roughness Tester TR200 from the company Ovovo.

The ball can may further comprise a lid, wherein the material of the lid is preferably different from the material of the can and/or from the material of the layer of the other material. Also, the density differences between the layer of the other material and the can lid material and/or between the ball can material and the can lid material are preferably at least 0.02 g/cm$^3$, more preferably at least 0.05 g/cm$^3$, and particularly preferably at least 0.1 g/cm$^3$.

Preferably, the roughened surface of the can wall is translucent, but still sufficiently transparent that it can be seen with the naked eye whether there is a ball in the ball can.

Preferably, apart from the can lid and the layer of the other material, the ball can consists of only one material, which is particularly advantageous in terms of recyclability. Against this background, it is also preferred that the ball can is not printed and that all marking is on the layer of the other material, since printing ink can also deteriorate the purity degree of the recycled material and/or render the reprocessing process complicated and expensive. For the same reasons, it is preferred that the ball can, i.e. in particular the can base and the can wall, is not inked.

In the following, a preferred embodiment of a ball can according to the invention is described in more detail with reference to FIG. 1.

FIG. 1 shows a top view of a ball can 1 comprising a can base 3 and a cylindrical can wall 2, wherein the can wall 2 at least in one or more sections comprises a roughened surface (not shown) and wherein, for marking the can, a layer of another material 4 is applied to the can wall 2 such that the surface roughened at least in one or more sections is at least partially exposed. In the illustrated preferred embodiment, the ball can further comprises a can lid 5. The layer of another material 4 is configured here in the form of a band extending around the entire outer circumference of the can wall 2 and covering less than 40% of the outer surface.

The invention claimed is:

1. A ball can comprising a can base and a can wall, wherein the can wall at least in one or more sections comprises a roughened surface and wherein, for marking the can, a layer of another material is applied to the can wall such that the surface roughened at least in one or more sections is at least partially exposed;

wherein the layer of another material has another density than the density of the ball can material, wherein a difference in density is at least 0.02 g/cm$^3$;

wherein the ball can comprises polyethylene terephthalate;

wherein a roughness of the can wall is characterized by one or more of the following parameters: Ra at least 0.5 μm, Ra at least 1.0 μm, Ra at least 1.5 μm, Ra at least 2.0 μm, Rz at least 2.0 μm, Rz at least 4.0 μm, Rz at least 6.0 μm, Rz at least 8.0 μm, Rz at least 10.0 μm.

2. The ball can according to claim 1, wherein the can wall comprises an outer surface and wherein the layer of another material covers at most 80% of the outer surface.

3. The ball can according to claim 1, wherein the can wall comprises an outer circumference and the layer of another material comprises a band extending around an entire outer circumference.

4. The ball can according to claim 1, wherein the layer of another material is adhered to the can wall.

5. The ball can according to claim 4, wherein the can wall includes an adhesive area and the adhesive area measures at most 3,000 mm$^2$.

6. The ball can according to claim 4, wherein an adhesive is water-soluble or comprises one or a combination of the following materials: hot-melt adhesive based on EVA or on polyethylene.

7. The ball can according to claim 1, wherein the difference in density is at least 0.05 g/cm$^3$.

8. The ball can according to claim 1, wherein the layer of another material comprises one or a combination of the following materials: oriented polypropylene, PET, pearlescent BOPP film, coated paper, bio-PLA.

9. The ball can according to claim 1, wherein the ball can comprises one or a combination of the following materials: polyethylene, polypropylene, polycarbonate, aluminum, tin paper, wood, bamboo, coated paper.

10. The ball can according to claim 1, wherein the weight of the ball can, i.e. of the can base and the cylindrical can wall without the lid and the layer of another material, is at most 40 g.

11. The ball can according to claim 1, wherein the roughness of the ball can wall characterized by Ra at least 2.0 μm.

12. The ball can according to claim 1, wherein the ball can further comprises a lid, wherein the material of the lid is different from the material of the can or from the material of the layer of another material.

13. The ball can according to claim 12, wherein the layer of the other material has another density than the density of the can lid material wherein the difference in density is at least 0.02 g/cm$^3$.

14. The ball can according to claim 12, wherein the ball can has another density than the density of the can lid material, wherein the difference in density is at least 0.02 g/cm$^3$.

15. The ball can according to claim 1, wherein the can wall is configured to be circular cylindrical.

16. The ball can according to claim 1, wherein the ball can further comprises an aluminum closure and wherein, apart from this aluminum closure, the ball can consists of only one material.

17. The ball can according to claim 1, wherein the ball can is not printed.

18. The ball can according to claim 1, wherein the ball can is not inked.

19. A ball can comprising a can base and a can wall, wherein the can wall comprises a roughened surface and wherein, for marking the can, a layer of another material is applied to the can wall such that the roughened surface is at least partially exposed;

wherein the can wall comprises an outer circumference and wherein the layer of another material extends around at least 50% of the outer circumference;

wherein the layer of another material has another density than the density of the ball can material, wherein a difference in density is at least 0.02 g/cm$^3$;

wherein the ball can comprises polyethylene terephthalate;

wherein a roughness of the can wall is characterized by one or more of the following parameters: Ra at least 0.5 μm, Ra at least 1.0 μm, Ra at least 1.5 μm, Ra at least 2.0 μm, Rz at least 2.0 μm, Rz at least 4.0 μm, Rz at least 6.0 μm, Rz at least 8.0 μm, Rz at least 10.0 μm.

20. A ball can comprising a can base and a can wall, wherein the can wall comprises a roughened surface and wherein, for marking the can, a layer of another material is applied to the can wall such that the roughened surface is at least partially exposed;

wherein the roughened surface of the can wall is sufficiently transparent that it can be seen with a naked eye whether there is a ball in the ball can;

wherein the layer of another material has another density than the density of the ball can material, wherein a difference in density is at least 0.02 $g/cm^3$;

wherein the ball can comprises polyethylene terephthalate;

wherein a roughness of the can wall is characterized by one or more of the following parameters: Ra at least 0.5 μm, Ra at least 1.0 μm, Ra at least 1.5 μm, Ra at least 2.0 μm, Rz at least 2.0 μm, Rz at least 4.0 μm, Rz at least 6.0 μm, Rz at least 8.0 μm, Rz at least 10.0 μm.

* * * * *